United States Patent [19]

Shimizu

[11] 4,297,835

[45] Nov. 3, 1981

[54] SYNTHETIC STRINGS

[76] Inventor: Mituo Shimizu, 3-32 Kayabacho Chikusaku, Nagoya City, Japan

[21] Appl. No.: 96,685

[22] Filed: Nov. 23, 1979

[51] Int. Cl.[3] ..... D02G 3/36

[52] U.S. Cl. ..... 57/251; 57/232; 57/234; 57/7; 57/297

[58] Field of Search ..... 57/210, 225, 230, 232, 57/243, 248, 250, 251, 6, 7, 8, 295, 297

[56] References Cited

U.S. PATENT DOCUMENTS

| | | | |
|---|---|---|---|
| 2,245,412 | 0/1937 | Pilgrim | 57/250 X |
| 3,164,947 | 1/1965 | Gaston | 57/248 X |
| 3,474,703 | 10/1969 | Davis | 57/251 X |
| 3,529,323 | 9/1970 | Hughey | 57/248 X |
| 3,605,399 | 9/1971 | Rijswijk | 57/248 X |
| 4,120,146 | 10/1978 | Robin | 57/251 X |

*Primary Examiner*—Donald Watkins
*Attorney, Agent, or Firm*—Gifford, VanOphem, Sheridan & Sprinkle

[57] ABSTRACT

An integrated string consisting of plural mono-filaments, each of which being fused together with adjacent mono-filaments at the contact points and externally having sharp grooves produced by twisting along its length and internally defining confined spiral bores between the component mono-filaments along its length. The external spiral grooves produced by twisting provide frictional resistance against slipping without deteriorating the specific surface tenacity and the tensile strength of the component synthetic mono-filaments. The internal spiral bores between the component mono-filaments improve the flexibility of the string.

12 Claims, 10 Drawing Figures

SYNTHETIC STRINGS

BACKGROUND OF THE INVENTION

The background of the invention will be described on the use of the string for the racket string and the fishing line, which are the principal uses of the string of the present invention.

Sheep gut had been commonly used for the racket string until synthetic materials were developed and twisted strings mainly of nylon filaments replaced the sheep gut racket string. Typical synthetic racket strings consist of a single thick core and two layers of thirty or a single layer of sixteen to eleven thin filaments overlayed around the core filament. The combination of the core filament and the wrapping thin filaments are integrated by twisting, then subjected to resin treatment so that the core filament and the wrapping thin filaments are mutually bonded together.

The specific size of typical racket strings is shown below.

| USE OF THE STRING | DIA-METER | DEN-IER | CORRESPON-DING STRING GAUGE |
|---|---|---|---|
| Tennis racket string type A: | 1.47mm | 17600 | No. 80 |
| Tennis racket string type B: | 1.28mm | 13200 | No. 60 |
| Badminton racket string: | 0.81mm | 5820 | No. 24 |

The twist number is 2 t.p.i. for the respective strings.

Phenol resin is most commonly used for bonding the component filaments of the string. Phenol resin is applied to the string during the twisting process. The tensile strength of the string bonded by phenol resin is reduced to 70% of the tensile strength of a standard nylon monofilament as the surface of the component filaments of the string is eroded by the erosive action of the phenol resin. The surface of the external component filaments of thus bonded string also is roughened by the erosive action of the phenol resin so that the roughened surface may be damaged and fall off during the stringing of the racket. In order to prevent this damage, it is usual to apply protective coating of nylon resin to the surface of the phenol resin bonded string, however, these treatments reduce the specific strength of the component synthetic material and deteriorate the surface tenacity of the component filaments while reducing the sharpness of the spiral grooves, the frictional resistance of which is essential to the racket string. The intrinsic resistance of sheep gut effectively controls the ball and the resistance of the special grooves of the synthetic string produced by twisting the string corresponds to the intrinsic surface resistance of the sheep gut; therefore, degradation of the sharpness of the special grooves causes the performance of the synthetic string to reduce.

The surface twist grooves, high tensile strength and good flexibility are essential properties for the strings for fishing nets and fishing lines. Therefore, twisted strings are used for these purposes.

The string according to the present invention as hereinbefore described is a multi-filament string integrated by twisting into a substantially single string having a tensile strength exceeding the standard tensile strength of the equivalent nylon mono-filament by 1 to 3 Kgs, the intrinsic surface tenacity of the material, the original sharpness of the spiral twist grooves and high flexibility. These properties of the string of this invention provide a highly strong and durable racket string which effectively controls tennis balls. It will be well understood that the string according to the present invention is sufficiently provided with properties that satisfy the requirments of fishing nets and fishing lines.

Furthermore, although the string according to the present invention is constituted of twisted multi-filaments, the component filaments will not be damaged and broken separately, which is liable to occur in the conventional bonded multi-filament string because the component filaments are integrated in the form of a mono-filament. Thus, the string of the present invention has no possibility that the component filaments are damaged and broken separately.

Still further, when a hollow filament is used instead of a solid filament as the thick core filament, the flexibility of the string is improved still more and if the internal hollow space of the hollow core filament is filled with a dye coloured oil, liquid, fluorescent paint or oil or liquid containing suspended golden or silvery aluminium powder, the string will show beautiful appearance, which is expected to provide a great fish luring effect when the string is used for fishing nets.

Accordingly, an object of the present invention is to provide a twisted synthetic multi-filament string having the intrinsic surface tenacity and tensile strength of the synthetic material, twist grooves which provide frictional resistance against slipping and an improved flexibility provided by defined spiral bores defind between the component filaments. The string of the present invention is widely used for the racket strings, fishing net strings, fishing lines and other purposes.

Another object of the present invention is to provide a method and apparatus for manufacturing the string of the invention.

DETAILED EXPLANATION ON THE INVENTION

Figure 1:
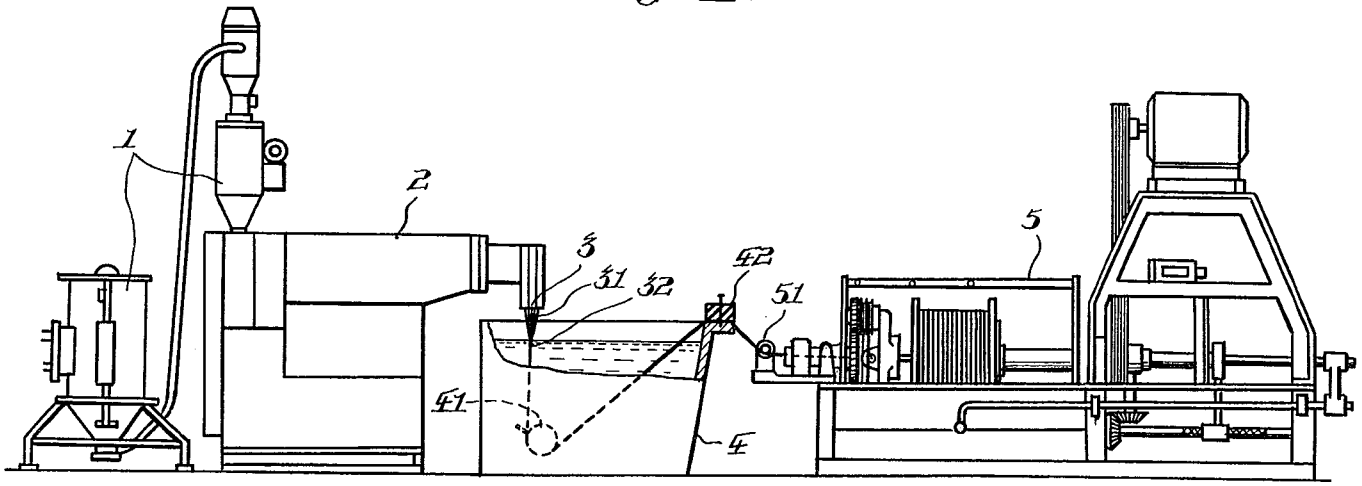
FIG. 1 is a diagrammatic illustration of the apparatus suitable for primary process of manufacturing the strings according to this invention.

Referring to FIG. 1, in the primary process, a string is twisted and wound up on a bobbin, but remains not drawn, then drawn to provide a desired thickness in the secondary process, not shown. Explanation on the secondary process will be omitted as the secondary process is the drawing and heat setting process well known.

Material nylon chips are melted in a dryer (1) and supplied to an extruder (2), which extrudes a parallel multi-filament (31) of a required thickness and a constitution through a nozzle (3). The diameter, number and arrangement of the holes of the nozzle (3) are specially designed corresponding to the constitution of the string to be manufactured, thus being entirely different from textile filament spinning nozzles.

Figure 2A:
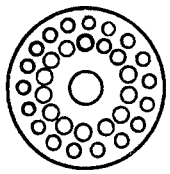
FIG. 2(A), 2(B) and 2(C) are front views of spinning nozzles for spinning composite multi-filaments including a thick core filament where the nozzle holes are arranged corresponding to respective purposes of the strings.
Figure 2B:
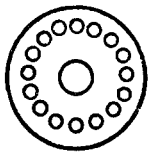
Figure 2C:
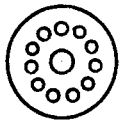
Figure 3A:
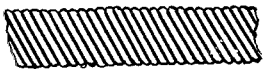
FIG. 3(A) and 3(B) are enlarged side views of strings with high twists inserted in the primary process and of finished condition, respectively.
Figure 3B:
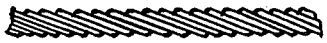

FIGS. 2(A), 2(B) and 2(C) are some examples of the spinning nozzle (3) designed as follows;

| | | |
|---|---|---|
| FIG. 2(A) | tennis racket string type A | |
| | center hole: | 4mm diameter / 1 hole. |
| | intermediate hole: | 2mm diameter / 10 holes. |
| | external hole: | 1.5mm diameter / 22 holes. |
| FIG. 2(B) | tennis racket string type B | |
| | center hole: | 4mm diameter / 1 hole |
| | external hole: | 1.5mm diameter / 16 holes. |
| FIG. 2(C) | badminton racket string | |
| | center hole: | 3mm diameter / 1 hole |
| | external hole: | 1mm diameter / 10 holes. |

The parallel multi-filament (31) extruded from the nozzle (3) is guided toward a cooling bath (4) in the molten state. In the preferred embodiment of this invention, such cooling bath contains water as a coolant. Immediately before submerging into the cooling water, the parallel multi-filament is twisted to produce a twisted strings (32). Twists produced by a twisting machine (5) advance along the string under coagulation in the cooling bath up to the point immediately above the surface of the cooling water where the string has the least twist resistance because the twisted string (32) is directly delivered to the head of the twisting machine without any interfacial restriction between the spinning nozzle and the head of the twisting machine.

The twisted string obtained through the primary process is not drawn, therefore, it is thicker and more severely twisted than the finished string, a finished racket string having twists of 2 t.p.i., for instance, is twisted as severely as 320 t.p.m. in the primary process, then drawn 4 to 5 times in the drawing process to produce a finished string. The twists produced by the twisting machine advance as far as the point immediately before the parallel multi-filament immerses into the cooling water where the parallel multi-filament is in the molten state as the string is directly guided between the spinning nozzle (3) and the head of the twisting machine without any restriction. Resistance applied to the string by the twisting machine through the cooling bath and the distance between the nozzle face and the cooling water surface are important operational factors to be regulated depending on the constitution, thickness and twists of the strand to be produced. In the drawings, (41) designates a guide pipe and pins disposed in the cooling bath for guiding the string, a water separating means (42) for separating cooling water from the string is made of foam rubber or the like and secured on a support by means of pins and (51) designates a guide roller in front of the twisting machine.

Usually, the parallel multi-filament extruded from the spinning nozzle is deformed as it is twisted and concentrated because it is in the molten state before immersing into the cooling water, however, according to the present invention, the parallel multi-filament is not immediately deformed due to the plasticity of the material and cooling of the string immediately after twists are inserted to the parallel multi-filament and the external surface of the string is cooled in the initial stage of cooling so that sharp twist grooves remains along the external surface of the string. The string is cooled starting from the outside gradually to the central portion and the internal filaments remain in the molten state for a few moment after the string has immersed in the cooling water so that the adjacent filaments are fused by the squeezing force applied by the twists thus forming a integrated thick string having spiral bores between the component filament. This formation of the string is kept after the drawing process, thus the finished string also has external sharp twist grooves and internal spiral bores. The twisting machine employed in the primary process is a conventional flyer lead type twisting machine commonly used for twisting strings or strands. The front mechanism or head of the twisting machine pulls and twists the string (32). The twists inserted by the flyer advances directly along the string through the cooling bath up to the position immediately above the surface of the cooling water.

Figure 4A:
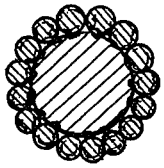
FIG. 4(A) and 4(B) are enlarged cross sectional views of the conventional racket strings.
Figure 4B:
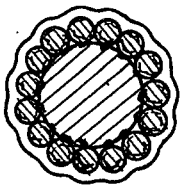
Figure 4C:
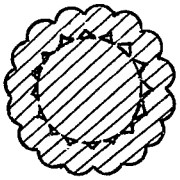
FIG. 4(C) is a cross sectional view of a racket string according to the present invention with a solid core filament.
Figure 4D:
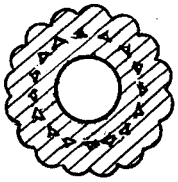
FIG. 4(D) is a cross sectional view of a racket string according to the present invention with a hollow core filament.

Refering now to FIG. 4, differences between the conventional tennis racket strings and a tennis racket string of this invention will be described. FIG. 4(A) and 4(B) are cross sectional views of the conventional tennis racket strings. The surface of the core filament and the surrounding external filament are eroded and bonded by phenol resin showing brown surfaces and boundaries. The spiral bores confined between the filaments are irregular. The surface of the string shown in FIG. 4(B) is coated with nylon resin so that the sharpness of the spiral by twisted grooves is reduced. In the strings of this invention illustrated by FIGS. 4(C) and 4(D), component filaments are substantially fused to form an integrated string similar to a mono-filament. The string has regularly disposed spiral bores confined between the component filaments and the external sharp twist grooves. The spiral bores are continuous in the direction of the length of the string and the number of the spiral bores increases according as the number of the component filaments, therefore, even a considerably thick string is substantially flexible. It may be well understood from the manufacturing method of the present invention that, when the string is constituted of two or more layers of filaments, all the layers of the special bores confined between the filaments are twisted in the same direction. FIG. 4(D) is a sectional view of a string of the present invention wherein the core is a thick hollow filament.

The characteristic features of the finished string of the invention will be described hereinafter.

Although the string is a twisted multi-filament, the string is clear and not stained if natural nylon is used as the component filaments are fused with adjacent filaments to form an integrated string. Addition of a transparent finishing agent to the material improves the appearance of the string providing colorless, translucent and beautiful strings. Conventional bonded strings are often dyed to make the stain caused by errosion inconspicuous, which is unnecessary for the strings of this invention. This specific advantage of the string of this invention is applicable to make the appearance of the string more beautiful by filling the hollow space of the core filament with a dyes coloured oil or liquid, fluorescent paint or an oil or liquid containing golden or silvery aluminium powder.

The coloured strings thus produced will not fade and maintain the original beautiful appearance. Especially, the strings filled with fluorescent paint or an oil or liquid containing golden or silvery aluminium powder, which is impossible to provide by dyeing or dope dyeing, are favourably applicable for the fishery purposes. The application of the specific feature of the strings of this invention is not confined within the usages for the racket strings and the fishery purposes, but also widely applicable for the decorative purposes.

A method of filling the hollow space of the core filament with a dye a coloured oil or liquid containing golden or silvery aluminium powder will now be described.

The apparatus employed by the present invention similar to the conventional apparatus used in the hollow filament manufacturing process wherein a spindle having a thin injection needle is provided for the nozzle hole of an extruder and the injection needle in concentrically disposed through the nozzle hole. The injection needle injects pressurized air into the filament in the axial direction, thus producing a hollow filament. According to the present invention, a dye coloured oil or liquid, fluorescent paint or an oil or liquid containing golden or silvery aluminium powder is injected into the filament instead of the air. In applying this method of the present invention to the core filament of a string, the structure of the nozzle head is required to be constructed so that the provision of the injection needle will not affect the extrusion pressure for the surrounding filament. This method is not capable of extruding filament having diameters less than 0.8 mm at the present time. The oils, liquids, fluorescent paints or colour powders injected in the molten nylon are exposed, although for an instant, to a high temperature as high as 250 degrees centigrade, which is the melting point of nylon, accordingly, it is required that the boiling point of the oils and liquids are, at the lowest, 150 degrees centigrade and the oils and liquids are resistant to browing and unfadable around this degree of the process temperature. Colourless and transparent oils and liquids, for example, such as most vegetable oils, for example, sesame oil, mineral oils for example, liquid hydrocarbons as paraffin liquid, and metals such as metal alloys and salts having boiling or melting point somewhat below 200 degrees centigrade, are preferable.

Generally, liquid and oil injected in the molten plastics should have somewhat lower boiling temperature than the melting temperature of the plastics so as to prevent said liquid and oil from expanding suddenly.

As hereinbefore described, although the synthetic strings of the present invention have a specific construction, the manufacturing process is simple; extruding, colouring and twisting processings are integrated in the primary process and the strings are finished through the conventional drawing and heat-setting processings in the secondary process.

According to the present invention, the manufacturing cost is remarkably reduced $\frac{1}{2}$ or $\frac{1}{3}$ of the manufacturing cost of the conventional manufacturing process which includes a number of separate processes such as spinning, drawing and heat-setting of every component filament, twisting and simultaneous bonding of component filaments, resin coating and dyeing process.

What I claim is:

1. A string comprising:

a central filament;

at least one filament twisted around said central filament defining at least one continuous regularly disposed spiral bore therebetween; and means for fusing said at least one filament to said central filament such that the cross-sectional area of said at least one filament and of said central filament remain circular and such that said at least one continuous regularly disposed spiral bore is maintained whereby a solidly integrated monofilament string is formed.

2. A string as claimed in claim 1 wherein said at least one continuous spiral bore defines a triangular shape in cross-sectional area.

3. A string as claimed in claim 1, wherein said central filament has a portion defining an axial bore therethrough.

4. A string as claimed in claim 1 further comprising:

means for filling said at least one continuous regularly disposed spiral bore with a dye to enhance the appearance of said solidly integrated monofilament string.

5. A string as claimed in claim 1 further comprising:

means for filling said at least one continuous regularly disposed spiral bore with a liquid.

6. A string as claimed in claim 1 wherein said at least one filament has an external surface and at least one spiral fluted groove along said external surface.

7. A method of manufacturing string from molten material comprising the steps of:

extruding molten material from the face of a nozzle having a plurality of holes disposed in the face of said nozzle to form at least one molten filament and a core molten filament;

twisting said at least one molten filament around said core molten filament; and fusing said at least one molten filament around the external surface of said core molten filament and said at least one molten filament to itself without distorting the cross-sectional areas of each filament to form a solidly integrated monofilament string with a plurality of spiral bores between said at least one filament and said core filament.

8. A method as defined in claim 7 wherein said fusing step includes cooling each of said plurality of molten filaments and cooling said core molten filament.

9. A method as defined in claim 7 wherein said twisting step further includes spinning said nozzle.

10. A method as defined in claim 7 further comprising after said fusing step introducing a dye into said plurality of bores.

11. A method as defined in claim 7 wherein said plurality of spiral bores are triangular in shape.

12. A method as defined in claim 7 wherein said plurality of holes are at least two.

* * * * *

UNITED STATES PATENT AND TRADEMARK OFFICE

CERTIFICATE OF CORRECTION

PATENT NO. : 4,297,835

DATED : November 3, 1981

INVENTOR(S) : Mituo Shimizu

It is certified that error appears in the above—identified patent and that said Letters Patent is hereby corrected as shown below:

Column 2, line 32, "defined" should read -- confined --.

Signed and Sealed this

*Sixteenth* Day of *March 1982*

[SEAL]

*Attest:*

GERALD J. MOSSINGHOFF

*Attesting Officer*

*Commissioner of Patents and Trademarks*